US011684140B2

(12) United States Patent
Hassett et al.

(10) Patent No.: US 11,684,140 B2
(45) **Date of Patent: *Jun. 27, 2023**

(54) BACKPACK WITH MAGNETIC HYDRATION TUBE RETURN

(71) Applicant: Thule Sweden AB, Hillerstorp (SE)

(72) Inventors: Eric Hassett, Golden, CO (US); Derick Noffsinger, Denver, CO (US); Mark Thibadeau, Boulder, CO (US)

(73) Assignee: Thule Sweden AB, Hillerstorp (SE)

( * ) Notice: Subject to any disclaimer, the term of this patent is extended or adjusted under 35 U.S.C. 154(b) by 0 days.

This patent is subject to a terminal disclaimer.

(21) Appl. No.: 17/568,339

(22) Filed: Jan. 4, 2022

(65) Prior Publication Data

US 2022/0125184 A1 Apr. 28, 2022

Related U.S. Application Data

(63) Continuation of application No. 16/614,947, filed as application No. PCT/US2018/030767 on May 3, 2018, now Pat. No. 11,229,278.

(Continued)

(51) Int. Cl.
*A45F 3/16* (2006.01)
*A45F 3/04* (2006.01)

(52) U.S. Cl.
CPC ..... *A45F 3/16* (2013.01); *A45F 3/04* (2013.01); *A45F 2003/166* (2013.01)

(58) Field of Classification Search
CPC ..... A41F 1/002; A45C 13/1069; A45F 2003/166; A45F 2200/0566; A45F 3/04;

(Continued)

(56) References Cited

U.S. PATENT DOCUMENTS 11,229,278 B2 * 1/2022 Hassett ..... A45C 13/1069
2007/0181616 A9 8/2007 Horito et al.

(Continued)

FOREIGN PATENT DOCUMENTS

WO 2004086897 A1 10/2004
WO 2006020765 A2 2/2006

OTHER PUBLICATIONS

International Search Report and Written Opinion of the International Searching Authority for International Application No. PCT/US2018/030767, European Patent Office, Rijswijk, The Netherlands, dated Jun. 27, 2018, 9 pages.

*Primary Examiner* — Nathan J Newhouse
*Assistant Examiner* — Matthew T Theis
(74) *Attorney, Agent, or Firm* — Sterne, Kessler, Goldstein & Fox P.L.L.C.

(57) ABSTRACT

A hydration pack includes a main body, a strap, a bladder, a hydration tube, a first chain of magnets, and a second chain of magnets. The main body defines a storage compartment. The strap is coupled to the main body. The bladder is disposed in the storage compartment of the main body and configured to retain liquid. The hydration tube includes a proximal end coupled to the bladder and a distal end. The first chain of magnets is disposed on the strap. The second chain of magnets is disposed along a length of the hydration tube. The first and second chains of magnets are configured to connect by magnetic forces and disconnect by a force exceeding the magnetic force of the first and second chains of magnets.

20 Claims, 13 Drawing Sheets

Related U.S. Application Data

(60) Provisional application No. 62/509,476, filed on May 22, 2017.

(58) Field of Classification Search
CPC ... A45F 3/16; A45F 3/20; B67D 2210/00131; Y10T 24/32
USPC ..... 224/183
See application file for complete search history.

(56) References Cited

U.S. PATENT DOCUMENTS

| | | | |
|---|---|---|---|
| 2011/0006084 | A1 | 1/2011 | Staton |
| 2015/0320187 | A1 | 11/2015 | Kreutzer |
| 2017/0062109 | A1 | 3/2017 | Good |
| 2017/0172262 | A1 | 6/2017 | Paik |

* cited by examiner

BACKPACK WITH MAGNETIC HYDRATION TUBE RETURN

CROSS REFERENCE TO RELATED APPLICATIONS

This application is a continuation of U.S. application Ser. No. 16/614,947, filed Nov. 19, 2019, which is a National Stage Entry of International Application No. PCT/US2018/030767, filed May 3, 2018, which claims priority to U.S. Provisional Application No. 62/509,476, filed May 22, 2017, which are hereby incorporated herein in their entireties by reference.

BACKGROUND

Field

The present disclosure relates to hydration backpacks having a magnetic hydration tube return. More specifically, embodiments of the present disclosure relate to a diametrically opposed magnetic hydration tube return system and apparatus for automatic hydration tube return on a backpack.

Background

Hydration backpacks typically include a storage compartment containing a bladder for storing liquid and a hydration tube extending from the bladder to provide liquid to a user. Hydration tubes that are not secured to the backpack can be distracting or a safety hazard to the user, for example, by hanging and swaying while the user is engaged in activities (e.g., running, biking, hiking, climbing, kayaking, skiing, motorcycling, etc.). Manually returning the hydration tube, for example, to a clip can be difficult and inefficient when the user is engaged in activities. In order to eliminate unnecessary distractions, an automatic hydration tube return is needed that is consistent, effective, and simple to use so that the user can remain focused on other activities.

BRIEF SUMMARY

In some embodiments, a hydration backpack includes a main body defining a storage compartment, a pair of shoulder straps coupled to the main body, a bladder disposed in the storage compartment of the main body and configured to retain liquid, a hydration tube having a proximal end coupled to the bladder and a distal end, a first longitudinal elongated metallic element disposed on one shoulder strap of the pair of shoulder straps, and a second longitudinal elongated metallic element disposed on the hydration tube.

In some embodiments, the first and second longitudinal elongated metallic elements are configured to connect by gravitational and magnetic forces and disconnect by a force exceeding the magnetic force of the first and second longitudinal elongated metallic elements. In some embodiments, the first and second longitudinal elongated metallic elements are ferromagnetic, paramagnetic, superparamagnetic, or ferrimagnetic. In some embodiments, the first and/or second longitudinal elongated metallic element is a magnet.

In some embodiments, the first longitudinal elongated metallic element is a first chain of magnets disposed end-to-end and the second longitudinal elongated metallic element is a second chain of magnets disposed end-to-end. In some embodiments, the first chain of magnets is disposed within a first sleeve coupled to the first shoulder strap and the second chain of magnets is disposed within a second sleeve coupled to the hydration tube. In some embodiments, the second sleeve is coupled to a third sleeve disposed about the hydration tube, where the third sleeve is configured to slide along a length of the hydration tube.

In some embodiments, the first and second chains of magnets are flexible. In some embodiments, the first and second chains of magnets are cylindrical. In some embodiments, the first and second chains of magnets each have a diameter of 1 to 5 mm and a length of 10 to 30 mm. In some embodiments, the first and second chains of magnets each contain 3 to 9 magnets. In some embodiments, the first and second chains of magnets are diametrically opposed.

In some embodiments, the hydration backpack includes a valve disposed at the distal end of the hydration tube. In some embodiments, the bladder includes a fill port for transferring liquid to and/or from the bladder and a discharge port for transferring liquid from the bladder. In some embodiments, the discharge port is connected to the proximal end of the hydration tube.

In some embodiments, the first and second chains of magnets are each diametrically magnetized magnets arranged such that they are diametrically opposed with opposite polarity. In some embodiments, the first and second chains of magnets are each radially magnetized magnets arranged such that they are radially opposed with opposite polarity. In some embodiments, the first and second chains of magnets are each arranged such that they are opposed with opposite polarity. In some embodiments, the first and second chains of magnets are each bendable magnets arranged such that they are opposed with opposite polarity.

In some embodiments, a hydration system for providing liquid to a user on demand includes a backpack having a main body with a front side facing towards and adjacent to a user's back when the backpack is carried, a back side facing away from the user's back when the backpack is carried, and a pair of shoulder straps coupled to the main body and configured to extend over the user's shoulders and chest. In some embodiments, a bladder disposed in the main body of the backpack is configured to retain liquid, the bladder including a fill port for transferring liquid to and/or from the bladder and a discharge port for transferring liquid from the bladder. In some embodiments, a hydration tube extends from the bladder through an opening in the main body and over the user's shoulder. In some embodiments, a valve is disposed at the distal end of the hydration tube and includes an outlet configured to discharge liquid into the user's mouth. In some embodiments, a first plurality of cylindrical magnets is coupled to a shoulder strap of the pair of shoulder straps, and a second plurality of cylindrical magnets is coupled to the hydration tube.

In some embodiments, the first and second pluralities of cylindrical magnets are configured to connect by gravitational and magnetic forces when the hydration tube is released from the user's mouth and disconnect when the user exerts a force exceeding the magnetic force of the first and second pluralities of cylindrical magnets. In some embodiments, the hydration tube is configured to transfer liquid from a proximal end connected to the discharge port to a distal end of the hydration tube.

In some embodiments, the first and second pluralities of cylindrical magnets are diametrically magnetized. In some embodiments, upon release of the valve from the user's mouth the second plurality of cylindrical magnets sequentially or simultaneously connects by magnetic force to the first plurality of cylindrical magnets.

In some embodiments, the hydration system includes an adjustable sleeve disposed about the hydration tube and configured to slide along a length of the hydration tube. In some embodiments, the second plurality of cylindrical magnets is coupled to the sleeve. In some embodiments, the magnets of the second plurality of cylindrical magnets are disposed end-to-end.

BRIEF DESCRIPTION OF THE DRAWINGS

The accompanying drawings, which are incorporated herein and form a part of the specification, illustrate the embodiments and, together with the description, further serve to explain the principles and to enable a person skilled in the relevant art(s) to make and use the embodiments. Objects and advantages of illustrative, non-limiting embodiments will become more apparent by describing them in detail with reference to the attached drawings.

Figure 1:
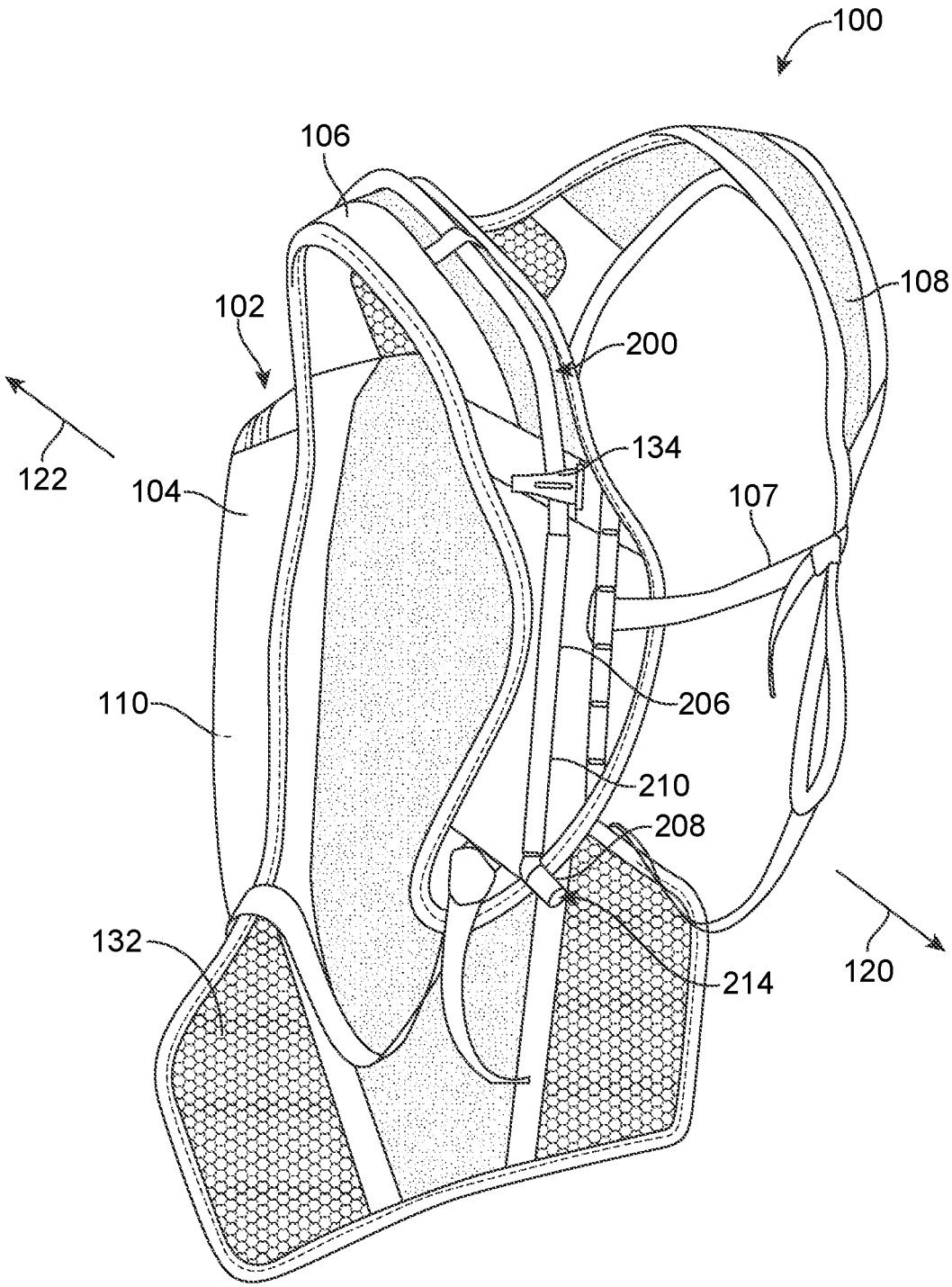
FIG. 1 illustrates a hydration backpack, according to an embodiment.

The features and advantages of the embodiments will become more apparent from the detailed description set forth below when taken in conjunction with the drawings, in which like reference characters identify corresponding elements throughout. In the drawings, like reference numbers generally indicate identical, functionally similar, and/or structurally similar elements.

DETAILED DESCRIPTION

Embodiments of the present disclosure are described in detail with reference to embodiments thereof as illustrated in the accompanying drawings. References to "one embodiment," "an embodiment," "some embodiments," etc., indicate that the embodiment(s) described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following examples are illustrative, but not limiting, of the present embodiments. Other suitable modifications and adaptations of the variety of conditions and parameters normally encountered in the field, and which would be apparent to those skilled in the art, are within the spirit and scope of the disclosure.

Hydration backpacks are used in a variety of activities, for example, running, biking, hiking, kayaking, skiing, motorcycling, or climbing. Hydration backpacks typically include a bladder, for example, within a storage compartment, which stores a liquid and transfers the liquid to a user via a hydration tube. It is advantageous to secure the hydration tube when not in use in order to avoid distraction and prevent harm to the user. Hydration tubes that are secured manually by the user to a secured position do not alleviate these problems. For example, a bicyclist may need to take one hand off of the handlebars in order to secure the hydration tube, which can be a safety hazard. The action of manually returning the hydration tube can be difficult and inefficient when the user is engaged in other activities as well (e.g., running, hiking, climbing, kayaking, etc.). Therefore, there is a need to reduce unnecessary distractions and improve user safety through an automatic hydration tube return system. This allows the user to remain focused on their primary activity. Further, the automatic hydration tube return is consistent, effective, and simple to use for children and adults engaged in a variety of activities.

Figure 2:
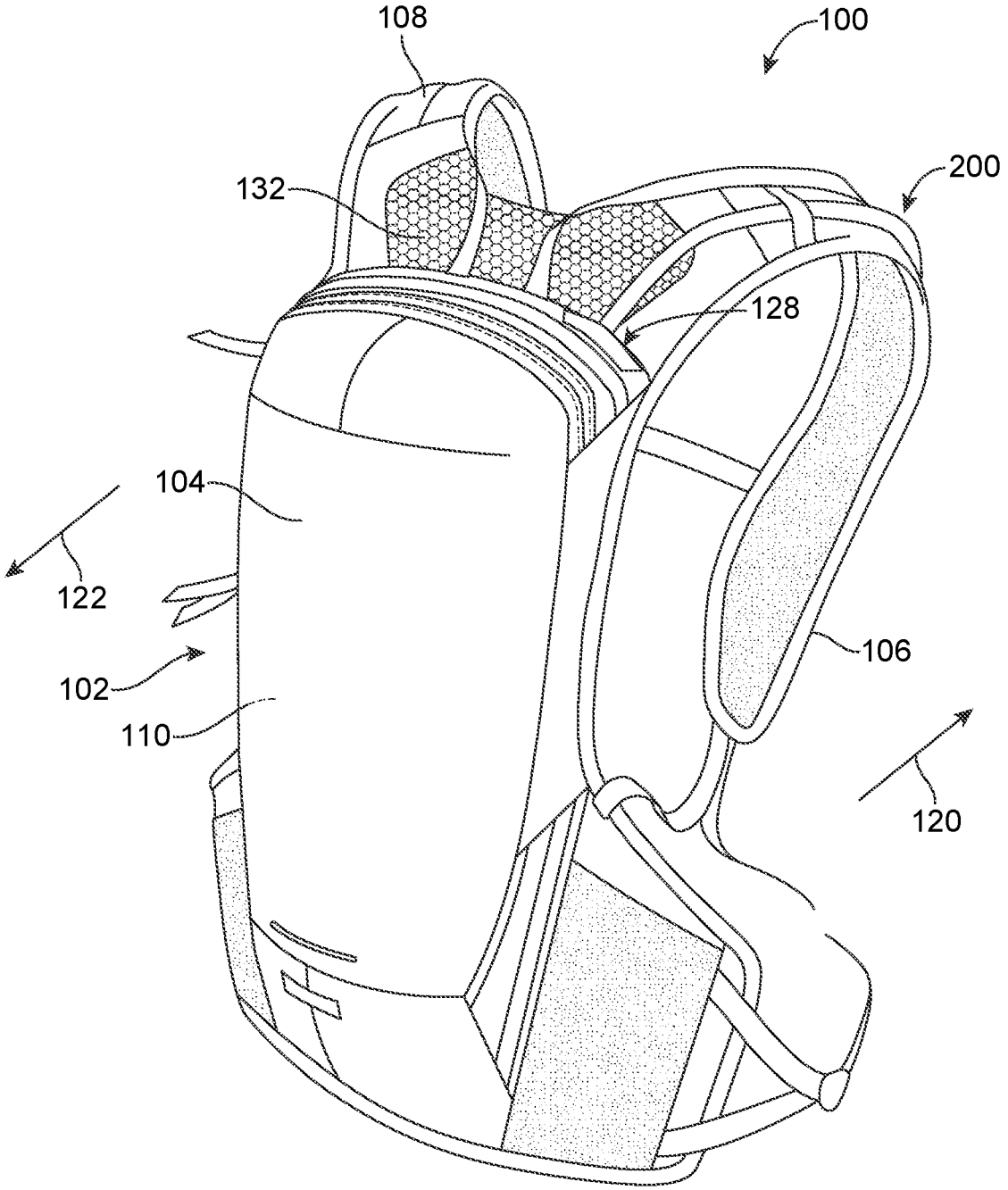
FIG. 2 illustrates a hydration backpack, according to an embodiment.
Figure 3:
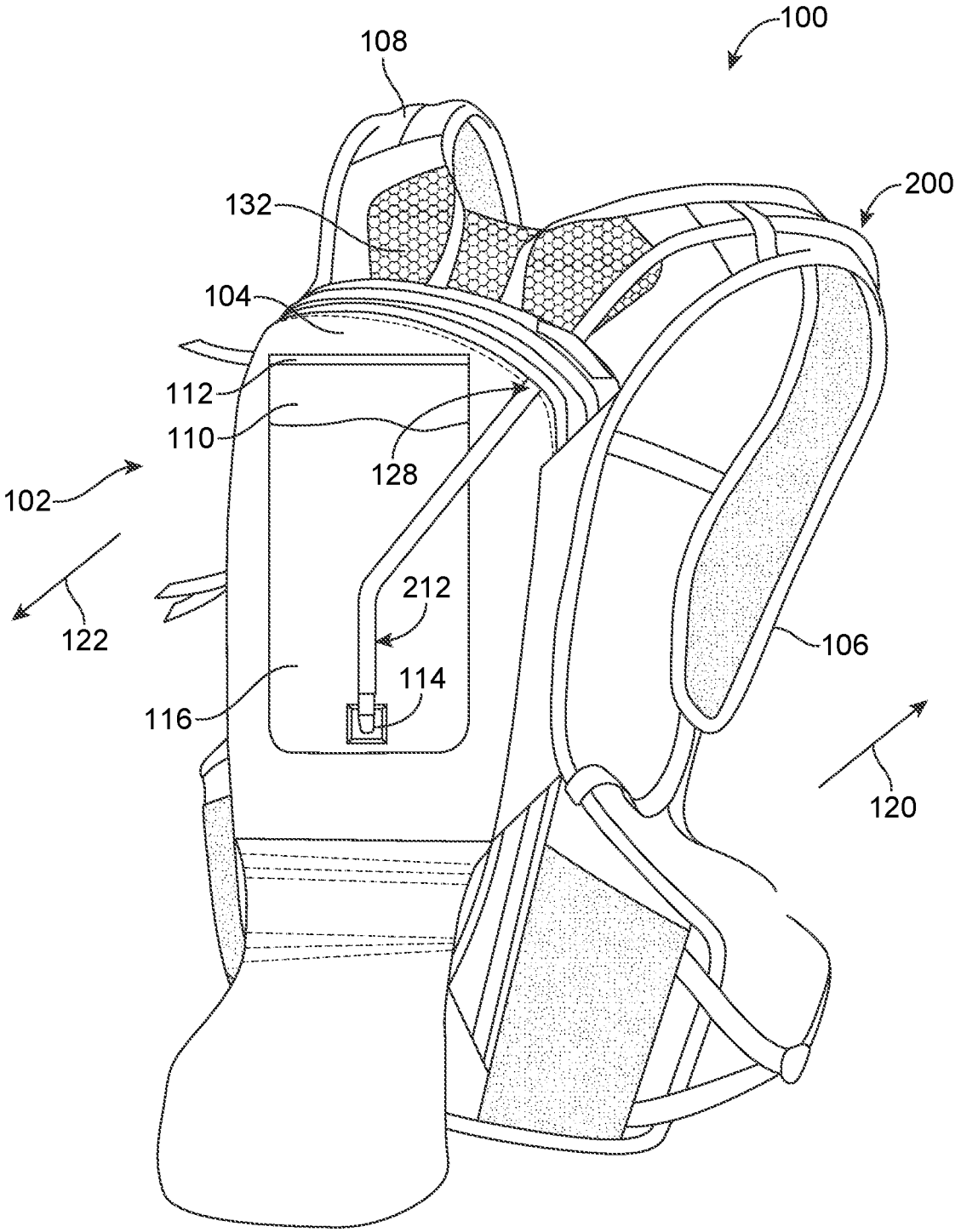
FIG. 3 illustrates a hydration backpack, according to an embodiment.

FIGS. 1-3 illustrate backpack 100, according to embodiments. In some embodiments, backpack 100 can include main body 102, storage compartment 104, first shoulder strap 106, second shoulder strap 108, bladder 110, webbing 132, clip 134, and hydration tube 200. When carried conventionally by the user, the shoulder straps 106, 108 can be generally disposed on a front side 120 of the user (i.e., over the shoulders and chest) and the main body 102 can be disposed on a back side 122 of the user (i.e., against the user's back). Shoulder straps 106, 108 can extend over the user's shoulders, around the user's chest, and reconnect with the main body 102. In some embodiments, the pair of shoulder straps 106, 108 can be adjustable. In some embodiments, a chest strap 107 can releasably couple shoulder straps 106, 108. In some embodiments, hydration tube 200 can extend along first shoulder strap 106. In some embodiments, hydration tube 200 (or a second hydration tube) can extend along second shoulder strap 108. Where particular features are described herein with respect to first shoulder strap 106, a person skilled in the art would understand how to employ the features for second shoulder strap 108.

As shown in FIG. 3, for example, in some embodiments, main body 102 can include storage compartment 104 that houses bladder 110. In some embodiments, bladder 110 can be disposed on an exterior of main body 102. In some embodiments, bladder 110 can include fill port 112 and discharge port 114. Bladder 110 can be filled with liquid 116, for example, water, juice, or sports drink. A user can open the fill port 112 to deposit liquid 116 into bladder 110 and seal the fill port 112 to store the liquid 116 inside. In some embodiments, bladder 110 can be a flexible bag, for example, a plastic bag, a rubber bag, a waterskin, or a wineskin, that can be sealed by fill port 112. For example, fill port 112 can be sealed by a tongue-and-groove seal, dovetail groove seal, vacuum seal, O-ring seal, bung seal, lid, cap, etc. In some embodiments, bladder 110 can be disposable. In some embodiments, bladder 110 can be reusable.

Hydration tube 200 can include a proximal end 212 and a distal end 210. In some embodiments, proximal end 212 can connect to discharge port 114 of bladder 110. In some embodiments, discharge port 114 can be an opening, for example, at the bottom of bladder 110. In some embodiments, discharge port 114 can be positioned at the top or side of bladder 110. In some embodiments, hydration tube 200 can be releasably connected to discharge port 114 by a suitable connector, for example, a quick-disconnect fitting, a Swagelok fitting, or other pressure sealable fitting. In some embodiments, valve 208 can be disposed at distal end 210 of hydration tube 200. Valve 208 can be, for example, a bite valve, a user-actuated valve, or a lockout valve. In some embodiments, valve 208 can include a lock-out device, for example, a pop-up sealing device, a push-pull sealing device, a clamp, a twist-lock valve, a butterfly valve, or a stopper. In some embodiments, hydration tube 200 can extend from within storage compartment 104, through opening 128 in main body 102, and extend along first shoulder strap 106.

As shown in FIG. 1, for example, distal end 210 of hydration tube 200 can include valve 208 with outlet 214. In some embodiments, valve 208 can be a bite valve configured to open when a user applies pressure by biting valve 208. In some embodiments, hydration tube 200 can be secured by clip 134, or other securement mechanism, along first shoulder strap 106 and extend along first shoulder strap 106 in a secured position. In some embodiments, clip 134 can be adjustable, for example, the angle and/or position of clip 134 along a length of first shoulder strap 106 can be changed by a user. In some embodiments, clip 134 can be disposed on second shoulder strap 108. In some embodiments, backpack 100 can include one or more areas of webbing 132, which can include pockets or inserts for modular attachments, for example, key chain, unused strap, cell phone, wallet, or other handheld device. In some embodiments, webbing 132 can form exterior and/or interior pockets on backpack 100. In some embodiments, webbing 132 can be formed on main body 102 for comfort, reduced weight, and improved airflow to the user. In some embodiments, webbing 132 can be elastic.

Figure 4:
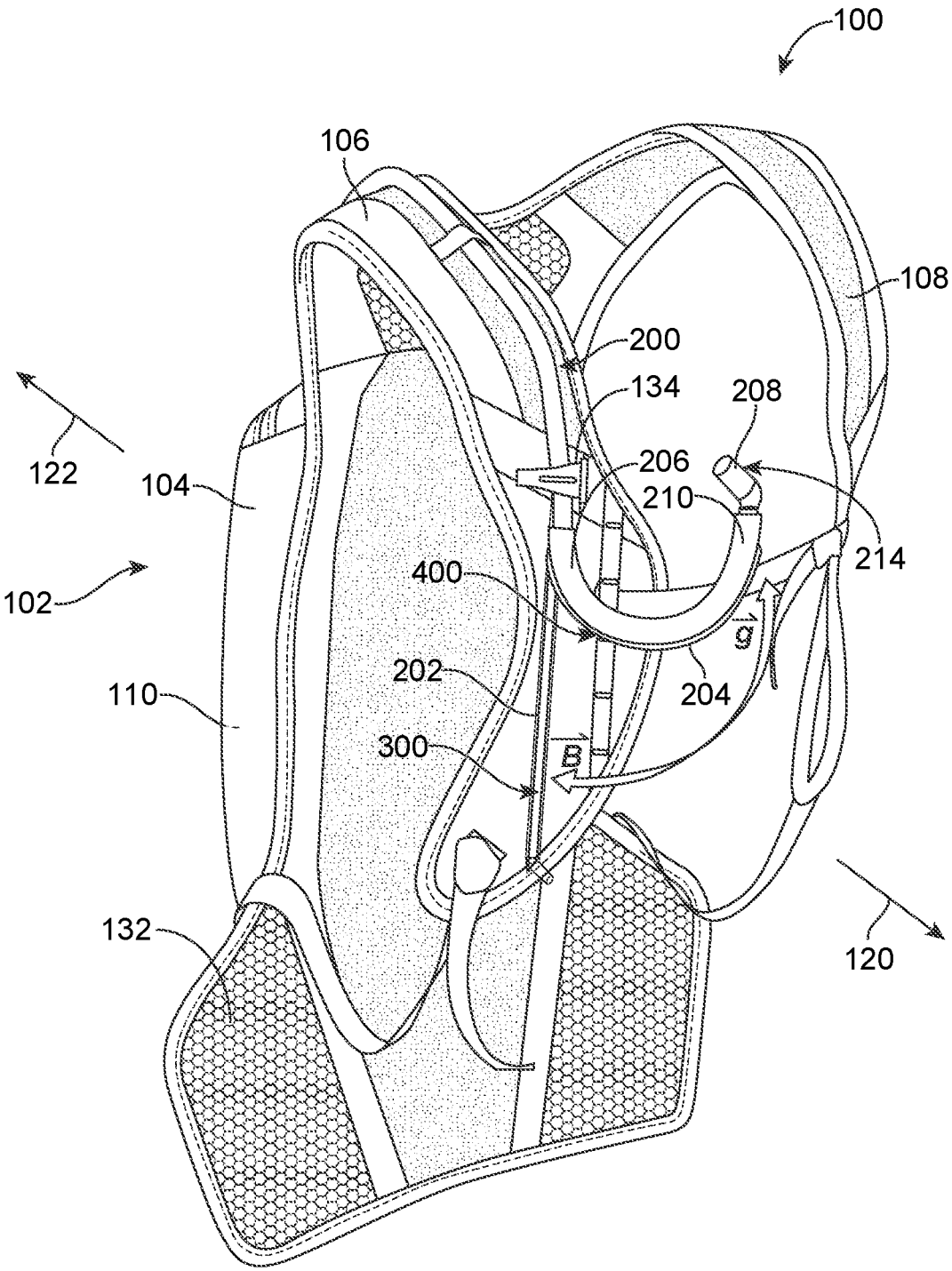
FIG. 4 illustrates a hydration backpack, according to an embodiment.
Figure 5:
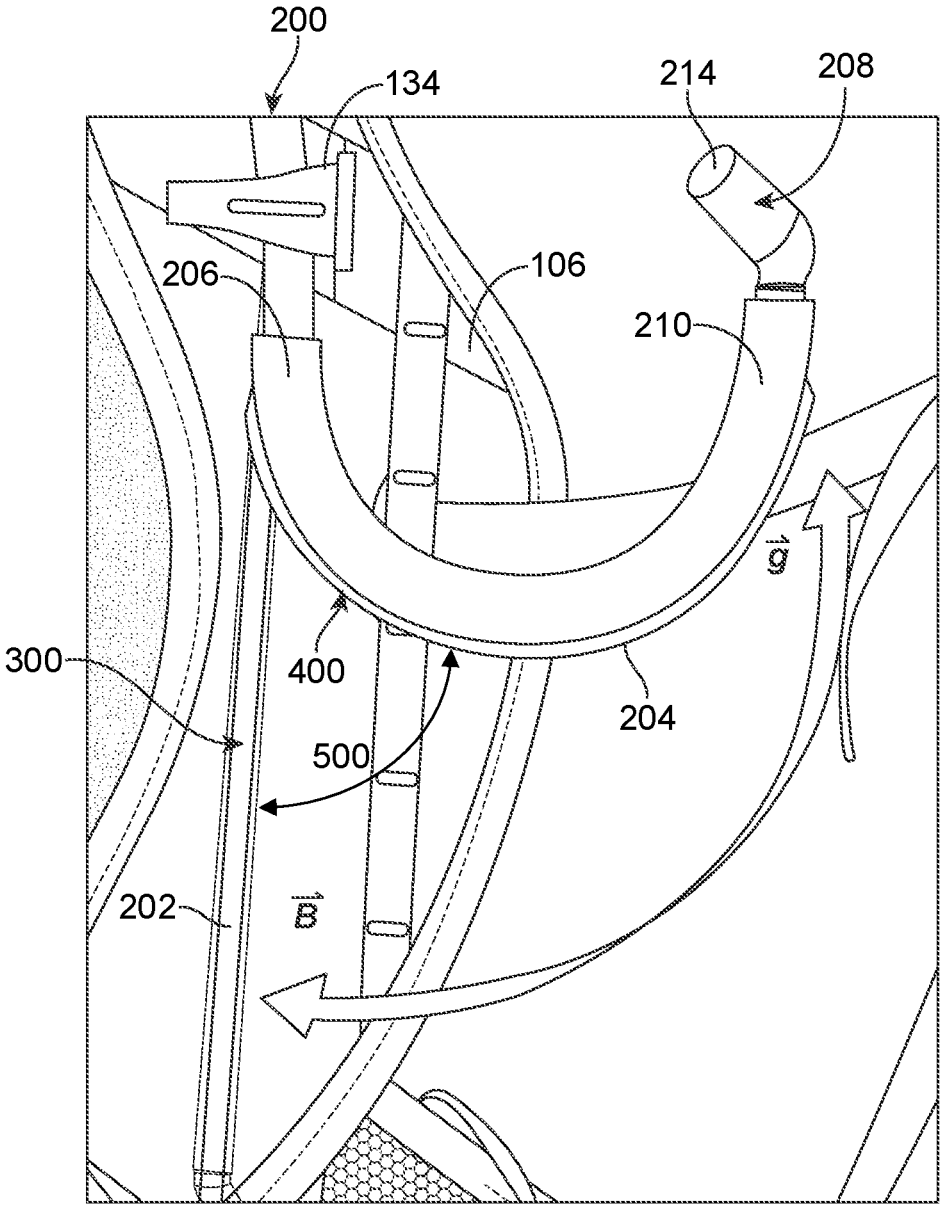
FIG. 5 illustrates a hydration tube return, according to an embodiment.

FIGS. 4-5 illustrate backpack 100, according to embodiments. Backpack 100 can include main body 102, storage compartment 104, first shoulder strap 106, second shoulder strap 108, bladder 110, webbing 132, clip 134, hydration tube 200, first longitudinal elongated metallic element 300, and second longitudinal elongated metallic element 400. In some embodiments, first longitudinal elongated metallic element 300 can be disposed in first sleeve 202, which can be coupled to first shoulder strap 106. In some embodiments, second longitudinal elongated metallic element 400 can be disposed in second sleeve 204, which can be coupled to hydration tube 200, for example, by adjustable sleeve 206. In some embodiments, adjustable sleeve 206 can slide along hydration tube 200 to adjust its position. In some embodiments, second longitudinal elongated metallic element 400 can be coupled to hydration tube 200, for example, by an adhesive. First and second longitudinal elongated metallic elements 300, 400 can be configured to connect by gravitational ($\vec{g}$) and magnetic ($\vec{B}$) forces and disconnect by an external force exceeding the magnetic ($\vec{B}$) force of first and second longitudinal elongated metallic elements 300, 400.

As shown in FIGS. 4-5, for example, in some embodiments, first and second longitudinal metallic elements 300, 400 can align with each other, such that first and second sleeves 202, 204 are adjacent when in a secured position. The secured position of first and second sleeves 202, 204 can be maintained by the magnetic ($\vec{B}$) force of the first and second longitudinal elongated metallic elements 300, 400. When hydration tube 200 is in a non-secured position (see e.g., FIGS. 5 and 6A), for example, pulled away from first longitudinal elongated metallic element 300 by the user, hydration tube 200 is subject to gravitational ($\vec{g}$) force in the vertical direction. When the gravitational ($\vec{g}$) force on hydration tube 200 is uninhibited (i.e., user releases hydration tube 200), hydration tube 200 swings in a downward arc toward first longitudinal elongated metallic element 300, similar to a pendulum swing. As the second longitudinal elongated metallic element 400 approaches first longitudinal elongated metallic element 300, the magnetic ($\vec{B}$) force of the first and second longitudinal elongated metallic elements 300, 400 increases and draws first and second longitudinal elongated metallic elements 300, 400 together. This also happens when first and second longitudinal elongated metallic elements 300, 400 are disposed in respective sleeves 202, 204.

Figure 6A:
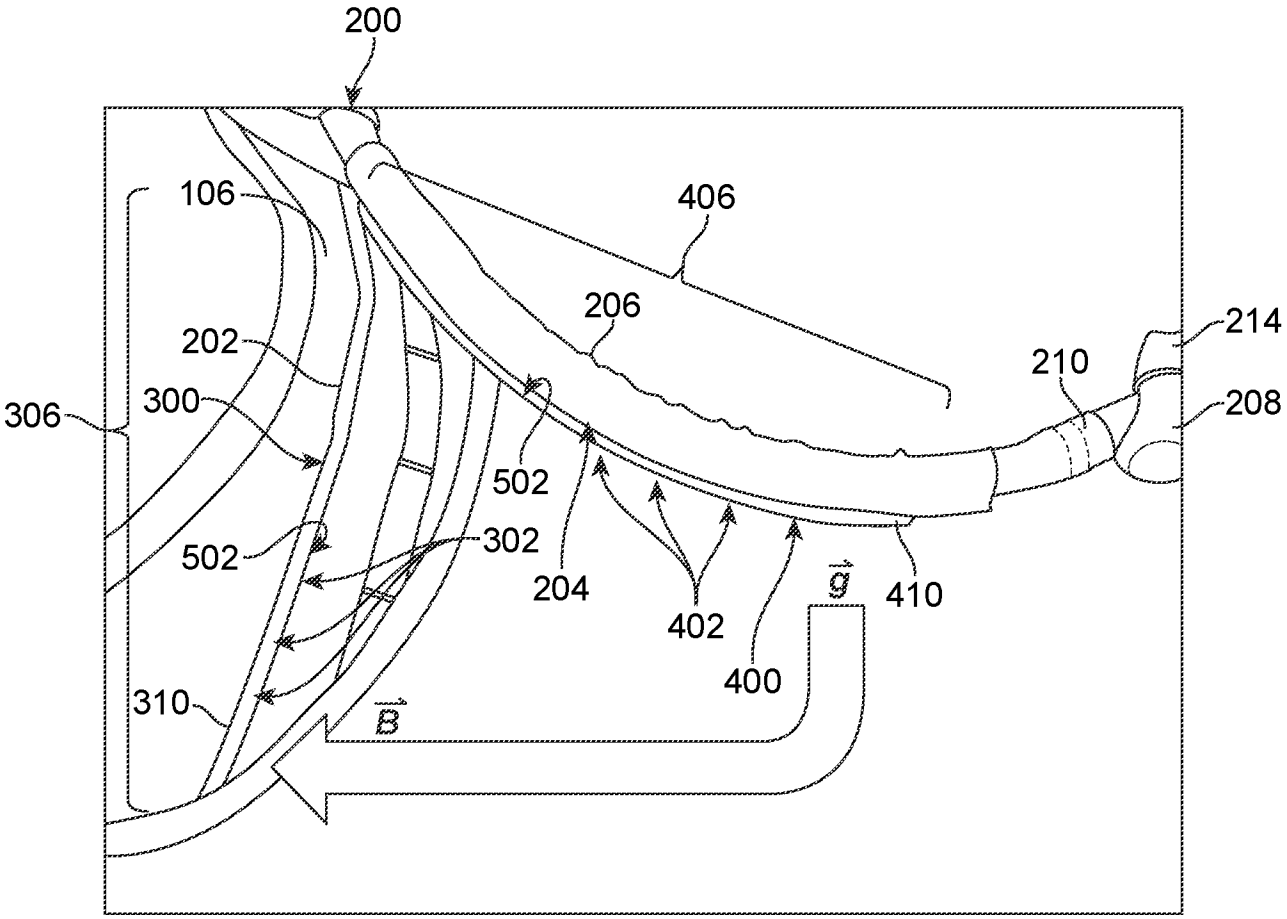
FIG. 6A illustrates a hydration tube return in an unsecured position, according to an embodiment.
Figure 6B:
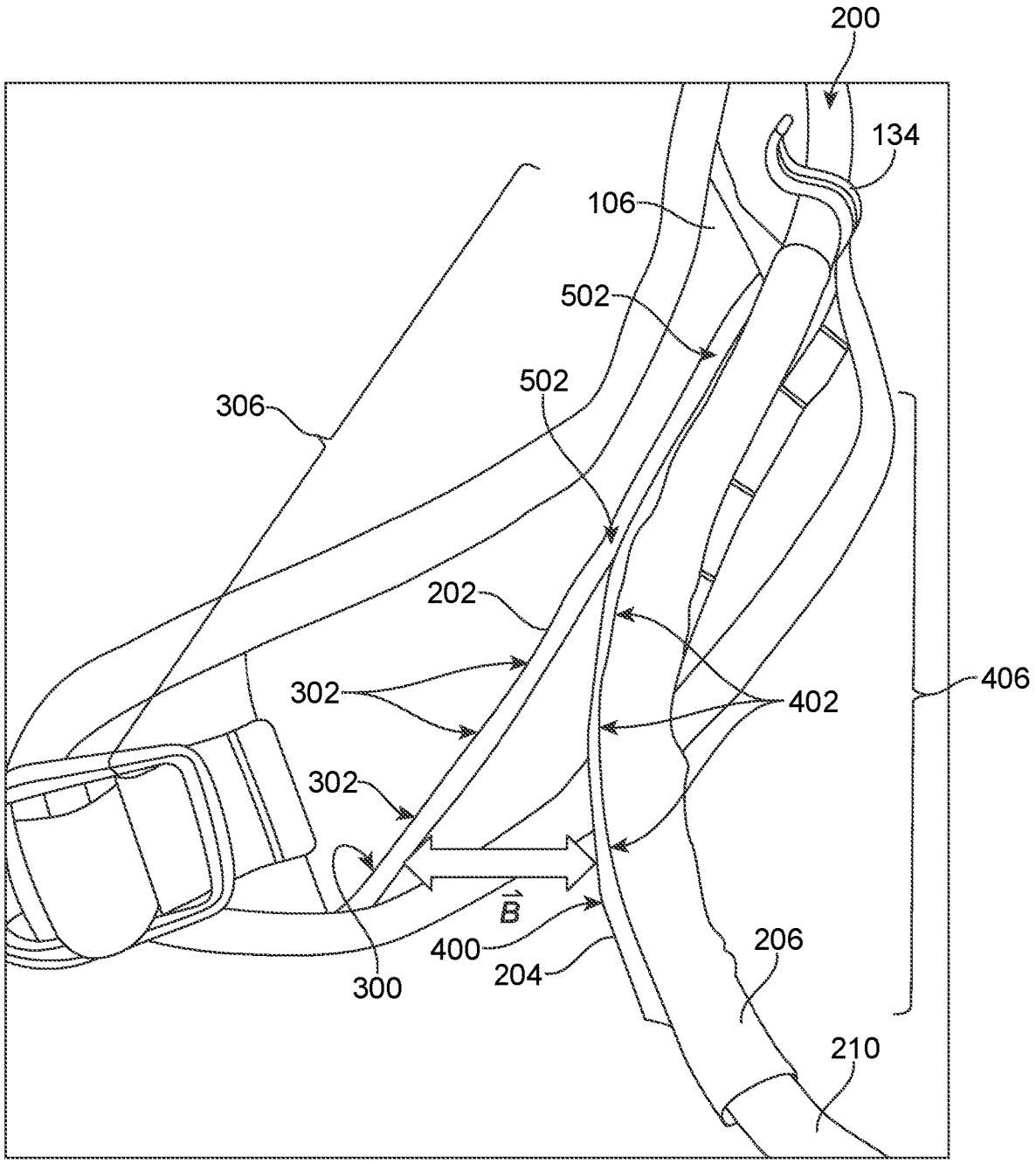
FIG. 6B illustrates a hydration tube return in a partially secured position, according to an embodiment.
Figure 6C:
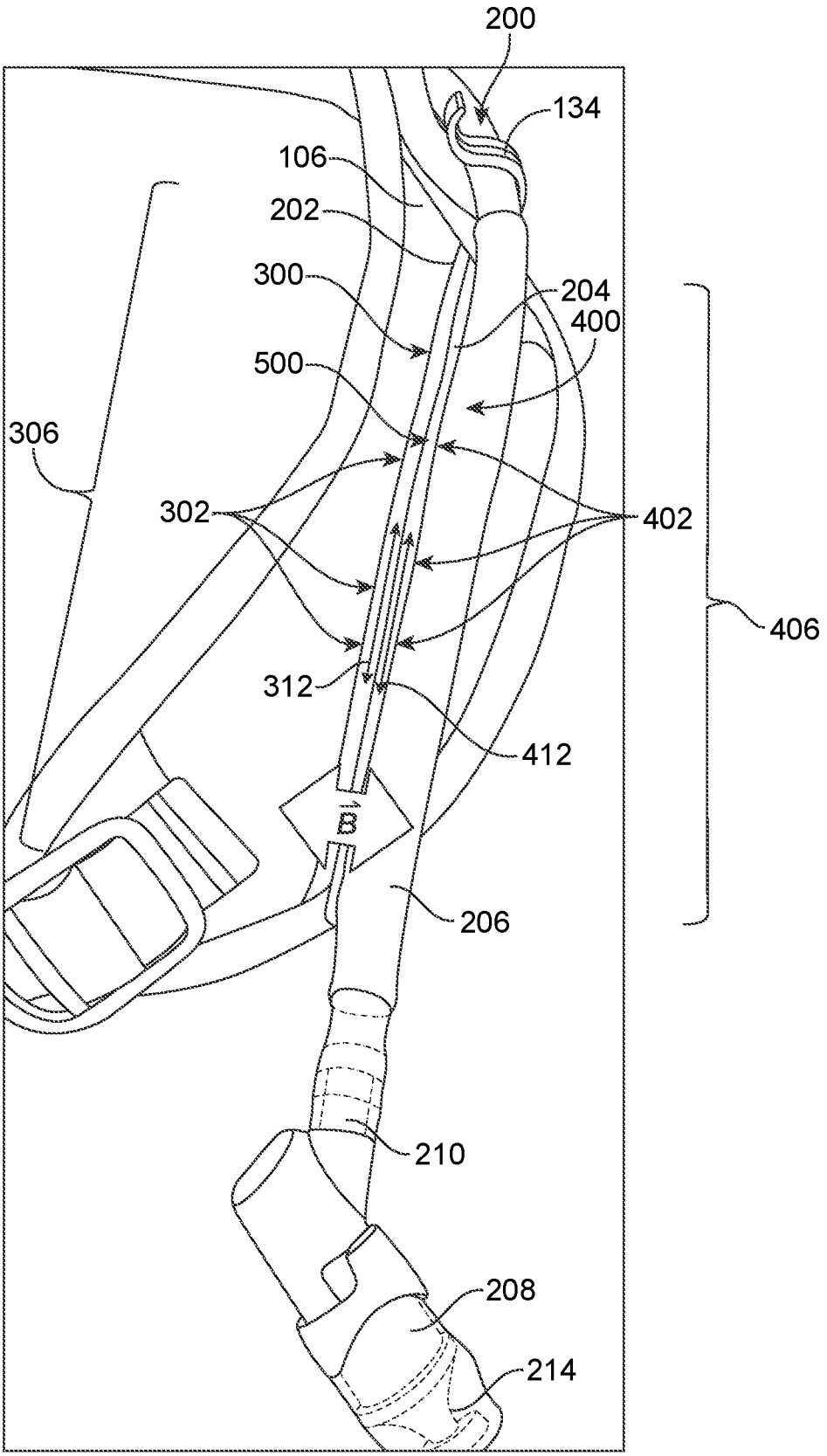
FIG. 6C illustrates a hydration tube return in a secured position, according to an embodiment.

In some embodiments, first and second longitudinal metallic elements 300, 400 can be configured to be diametrically opposed 500, which causes first and second sleeves 202, 204, as shown in FIG. 6C, for example, to be aligned longitudinally along the length of each sleeve. As described herein, "diametrically opposed" means that elements oppose each other along their diameters, such that first longitudinal axis 312 of first longitudinal metallic element 300 and second longitudinal axis 412 of second longitudinal metallic element 400 are parallel or near parallel when in a secured position.

In some embodiments, first sleeve 202 can be coupled to first shoulder strap 106, for example, by sewing, stitching, gluing, heat sealing, or other appropriate apparel manufacturing techniques. In some embodiments, second sleeve 204 can be coupled to adjustable sleeve 206, for example, by sewing, stitching, gluing, heat sealing, or other appropriate apparel manufacturing techniques. In some embodiments, second sleeve 204 can be formed, for example, by sewing, stitching, sealing, etc. adjustable sleeve 206. In some embodiments, first sleeve 202, second sleeve 204, and/or adjustable sleeve 206 can be made from a woven or non-woven fabric. In some embodiments, first sleeve 202, second sleeve 204, and/or adjustable sleeve 206 can be an elastic material, for example, Spandex, Lycra, elastane, or other flexible clothing polymer.

In some embodiments, first and second longitudinal elongated metallic elements 300, 400 are magnetic. For example, in some embodiments, first and second longitudinal elongated metallic elements 300, 400 can be ferromagnetic, for example, iron, nickel, cobalt, rare earth metals, or alloys thereof. In some embodiments, first and second longitudinal elongated metallic elements 300, 400 can be paramagnetic, for example, aluminum, titanium, iron oxide, or alloys thereof. In some embodiments, first and second longitudinal elongated metallic elements 300, 400 can be superparamagnetic, for example, injectable Poly(N-isopropylacrylamide)-Superparamagnetic Iron Oxide Nanoparticle (SPION) composite hydrogels, molecular magnets, single-molecule magnets (SMM), or alloys thereof. In some embodiments, first and second longitudinal elongated metallic elements 300, 400 can be ferrimagnetic, for example, magnetite, iron oxides, yttrium iron garnet (YIG), magnetic garnets, cubic ferrites, hexagonal ferrites, pyrrhotite, molecular magnets, single-molecule magnets (SMM), or alloys thereof.

In some embodiments, first longitudinal elongated metallic element 300 is a magnet. In some embodiments, second longitudinal elongated metallic element 400 is a magnet. In some embodiments, first and/or second longitudinal metallic elements 300, 400 can be first and second chains of magnets 302, 402, respectively. For example, in some embodiments, the magnets in first and second chains of magnets 302, 402 can be disposed end-to-end. For example, in some embodiments, the magnets in first and second chains of magnets 302, 402 can be spaced apart. In some embodiments, first and/or second longitudinal metallic elements 300, 400 can be cylindrical magnets. In some embodiments, first and/or second longitudinal metallic elements 300, 400 can be flexible or bendable. In some embodiments, first and/or second longitudinal metallic elements 300, 400 can be ball bearings. In some embodiments, first and/or second longitudinal metallic elements 300, 400 can be a series of ball bearings. In some embodiments, first and/or second longitudinal metallic elements 300, 400 can be a series of spaced ball bearings. In some embodiments, first and/or second longitudinal metallic elements 300, 400 can be magnetic ball bearings, for example, stainless steel, steel, iron, nickel, cobalt, aluminum, titanium, or other ferromagnetic, paramagnetic, superparamagnetic, or ferrimagnetic materials. In some embodiments, first and/or second longitudinal metallic elements 300, 400 can be diametrically magnetized magnets. For example, in some embodiments, first and second longitudinal metallic elements 300, 400 can be diametrically magnetized magnets arranged such that they are diametrically opposed with opposite polarity. In some embodiments, first and second longitudinal metallic elements 300, 400 can be each radially magnetized magnets. For example, in some embodiments, first and second longitudinal metallic elements 300, 400 can be radially magnetized magnets arranged such that they are diametrically opposed with opposite polarity. In some embodiments, first and second longitudinal metallic elements 300, 400 can be first and second pluralities of cylindrical magnets, respectively. For example, the first and second pluralities of cylindrical magnets can be diametrically magnetized magnets. In some embodiments, the first and second pluralities of cylindrical magnets can be radially magnetized magnets.

The sequential positions of hydration tube 200 in FIGS. 6A-C illustrate an automatic magnetic hydration tube return apparatus and system of backpack 100, according to an embodiment. In some embodiments, first shoulder strap 106 can include first sleeve 202. In some embodiments, first sleeve 202 can include first chain of magnets 302. In some embodiments, first chain of magnets 302 can be secured to first shoulder strap 106, for example, by adhesive. In some embodiments, first chain of magnets 302 can be disposed end-to-end, forming a chain along first length 306. In some embodiments, hydration tube 200 can include adjustable sleeve 206 with second sleeve 204 coupled thereto. In some embodiments, second sleeve 204 can include second chain of magnets 402. In some embodiments, second chain of magnets 402 can be secured to hydration tube 200, for example, by adhesive. In some embodiments, second chain of magnets 402 can be disposed end-to-end, forming a chain along second length 406. First and second chains of magnets 302, 402 can each be of opposite polarity 502, such that the magnetic ($\vec{B}$) force increases between first and second chains of magnets 302, 402 as the distance between them decreases. For example, as shown in FIG. 6A, bottom distal magnet 310 of first chain of magnets 302 has first polarity (e.g., N) while bottom distal magnet 410 of second chain of magnets 402 has second polarity (e.g. S), or vice versa. Because they are composed of a plurality of magnets, first and second chains of magnets 302, 402 can be flexible and therefore able to bend with hydration tube 200 and first shoulder strap 106, respectively. In some embodiments, first and second chains of magnets 302, 402 are cylindrical. In some embodiments, first and second chains of magnets 302, 402 each have a diameter of 1 to 5 mm and a length of 10 to 30 mm. In some embodiments, first and second chains of magnets 302, 402 each contain 3 to 9 magnets.

FIG. 6A illustrates hydration tube 200 in an unsecured position, for example, pulled away from first chain of magnets 302 by the user, according to an embodiment. FIG. 6B illustrates hydration tube 200 in a partially secured position, for example, after being released by a user, according to an embodiment. Upon release of the valve 208 or hydration tube 200 from the user's mouth, hand, or other restrictive force opposing or compensating for the gravitational ($\vec{g}$) force, first and second chains of magnets 302, 402 connect sequentially, as shown in FIG. 6B, or simultaneously along the longitudinal lengths 306, 406 of first and second sleeves 202, 204, respectively. FIG. 6C illustrates hydration tube 200 in a secured position, such that first and second chains of magnets 302, 402 are diametrically opposed 500, according to an embodiment.

Figure 7A:
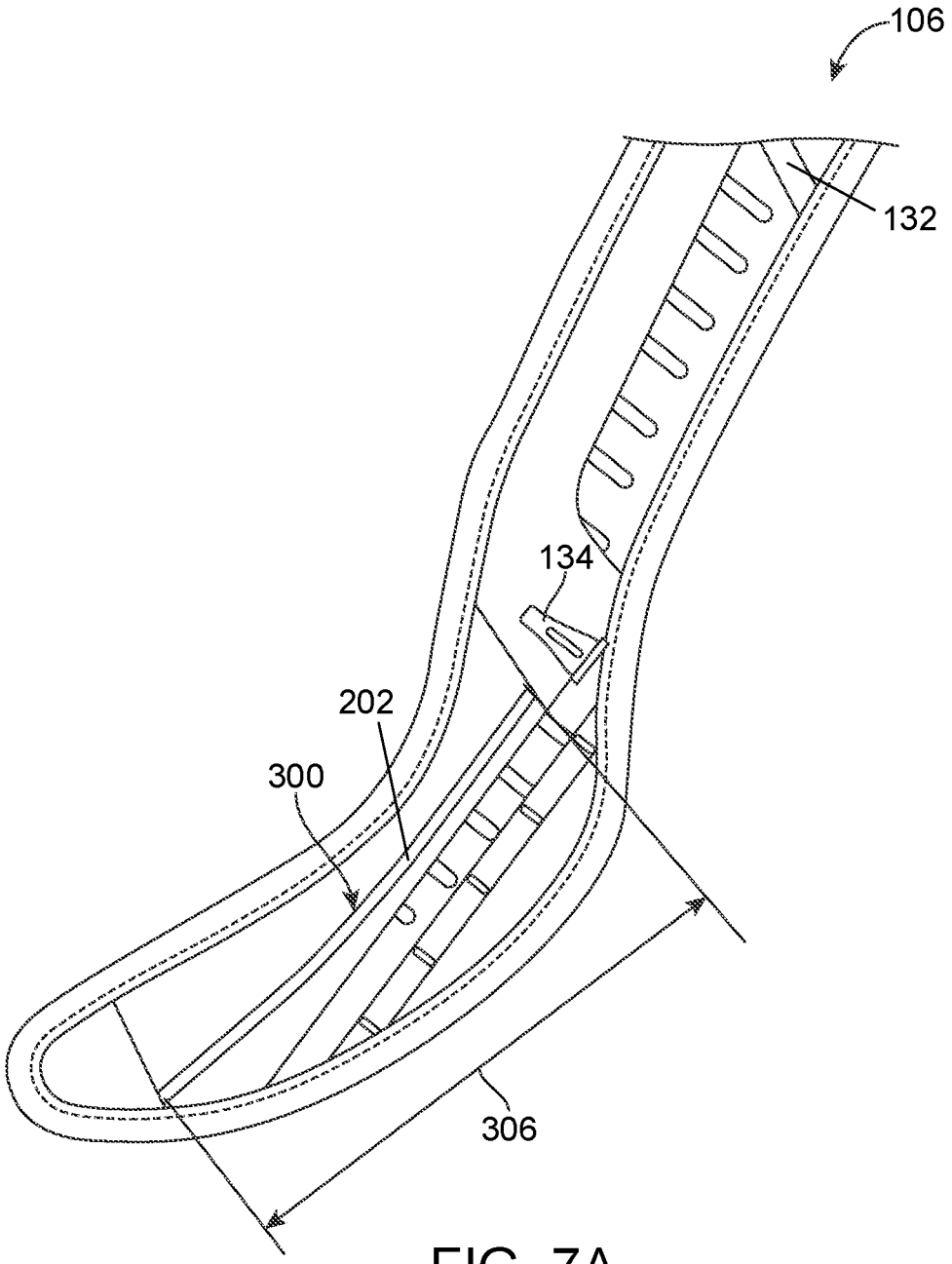
FIG. 7A illustrates a shoulder strap of a hydration backpack, according to an embodiment.
Figure 7B:
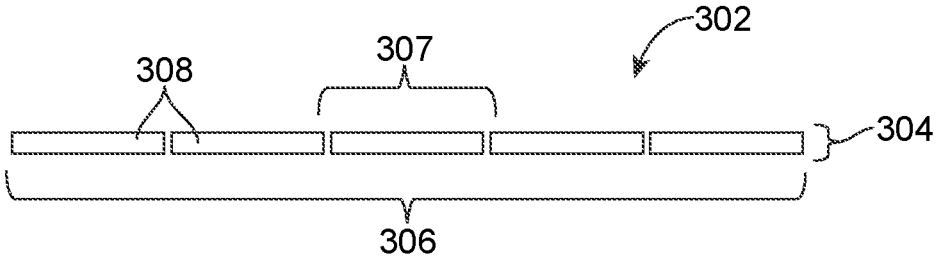
FIG. 7B illustrates a chain of magnets, according to an embodiment.

FIG. 7A illustrates first shoulder strap 106, according to an embodiment. In some embodiments, first shoulder strap 106 can include webbing 132, clip 134, first sleeve 202, and first longitudinal elongated metallic element 300. In some embodiments, first sleeve 202 can include first longitudinal elongated metallic element 300 along first length 306. As shown in FIG. 7B, in some embodiments, first longitudinal elongated metallic element 300 can include first chain of magnets 302. In some embodiments, first chain of magnets 302 can be cylindrical magnets 308. In some embodiments, each magnet can have the same length and the same diameter. In some embodiments, magnets can have different lengths and different diameters. In some embodiments, first chain of magnets 302 can have a diameter of 1 to 5 mm and a length of 20 to 500 mm. In some embodiments, first chain of magnets 302 can have a diameter of 3 mm. In some embodiments, first chain of magnets 302 can have a length of 120 to 180 mm. In some embodiments, first chain of magnets 302 can have a length of 160 mm. In some embodiments, first chain of magnets 302 can contain 2 to 15 magnets. In some embodiments, first chain of magnets 302 can contain 3 to 9 magnets. In some embodiments, first chain of magnets 302 can contain 5 to 7 magnets. In some embodiments, diameter 304 of magnet 308 can be 1 to 5 mm. In some embodiments, diameter 304 of magnet 308 can be 3 mm. In some embodiments, length 307 of magnet 308 can be 10 to 30 mm. In some embodiments, length 307 of magnet 308 can be 20 mm. In some embodiments, first chain of magnets 302 can include cylindrical magnets 308, arranged end-to-end inside first sleeve 202. In some embodiments, five cylindrical magnets 308, each having diameter 304, for example, a diameter of 3 mm and length 307, for example, a length of 20 mm, comprise first chain of magnets 302. In some embodiments, first chain of magnets 302 can be secured in first sleeve 202, for example, by sewing, stitching, or crimping. For example, first chain of magnets 302 can be secured such that first chain of magnets 302 does not rotate inside first sleeve 202.

Figure 8A:
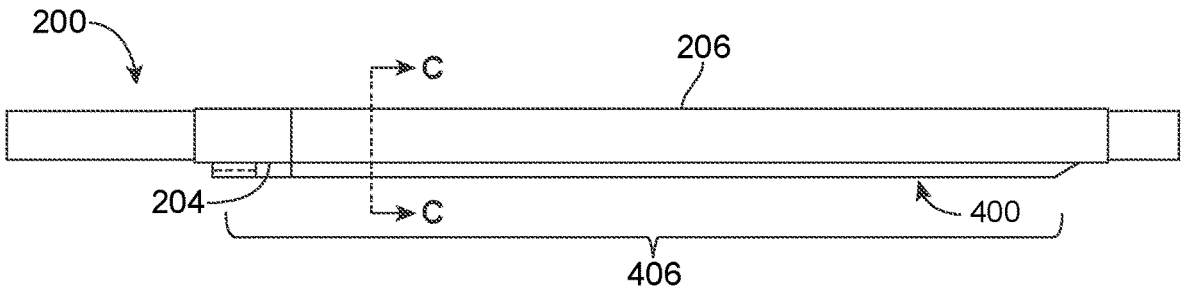
FIG. 8A illustrates a hydration tube, according to an embodiment.
Figure 8B:
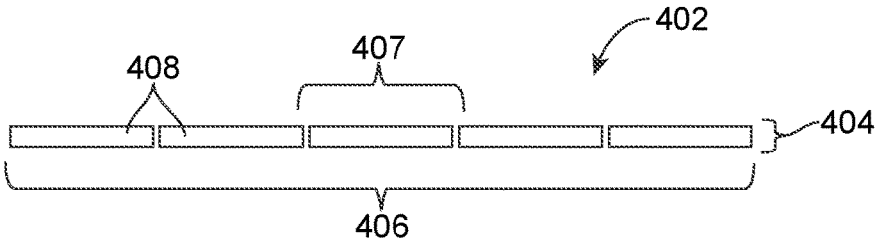
FIG. 8B illustrates a chain of magnets, according to an embodiment.
Figure 8C:
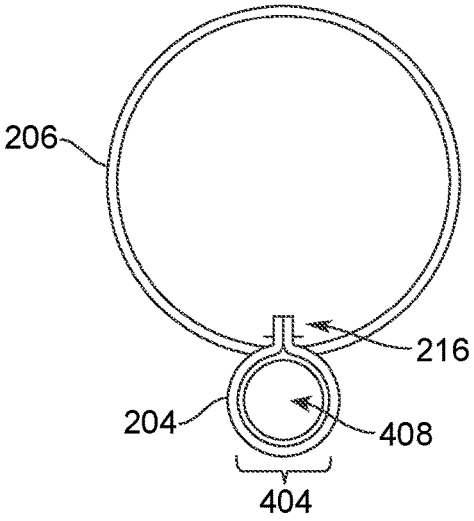
FIG. 8C illustrates a cross-sectional view of the hydration tube of FIG. 8A, according to an embodiment.

FIG. 8A illustrates hydration tube 200, according to an embodiment. As shown in FIG. 8A, in some embodiments, hydration tube 200 can include adjustable sleeve 206, second sleeve 204, and second longitudinal elongated metallic element 400. In some embodiments, second sleeve 204 can include second longitudinal elongated metallic element 400 along second length 406. As shown in FIG. 8B, in some embodiments, second longitudinal elongated metallic element 400 can include second chain of magnets 402 with second length 406 and second diameter 404. In some embodiments, second chain of magnets 402 can include cylindrical magnets 408, for example, arranged end-to-end inside second sleeve 204. In some embodiments, second chain of magnets 402 can have a diameter of 1 to 5 mm and a length of 20 to 500 mm. In some embodiments, second chain of magnets 402 can have a diameter of 3 mm. In some embodiments, second chain of magnets 402 can have a length of 120 to 180 mm. In some embodiments, second chain of magnets 402 can have a length of 160 mm. In some embodiments, second chain of magnets 402 can contain 2 to 15 magnets. In some embodiments, second chain of magnets 402 can contain 3 to 9 magnets. In some embodiments, second chain of magnets 402 can contain 5 to 7 magnets. In some embodiments, diameter 404 can be 1 to 5 mm. In some embodiments, diameter 404 of magnet 408 can be 3 mm. In some embodiments, length 407 can be 10 to 30 mm. In some embodiments, length 307 of magnet 308 can be 20 mm. In some embodiments, five cylindrical magnets 408, each having diameter 404, for example, a diameter of 3 mm and length 407, for example, a length of 20 mm, comprise second chain of magnets 402. In some embodiments, second chain of magnets 402 can be secured in second sleeve 204, for example, by sewing, stitching, or crimping. For example, second chain of magnets 402 can be secured such that second chain of magnets 402 does not rotate inside second sleeve 204. As shown in FIG. 8C, in some embodiments, second chain of magnets 402 can be secured in second sleeve 204 and attached to adjustable sleeve 206, for example, by stitching or crimping 216 along second sleeve 204 to secure the cylindrical magnets 408 while still allowing second chain of magnets 402 to flex and bend.

In some embodiments, first and second chains of magnets 302, 402 are each secured in first and second sleeves 202, 204, respectively, such that first and second chains of magnets 302, 402 are diametrically opposed. In some embodiments, first and second chains of magnets 302, 402 are each secured in first and second sleeves 202, 204, respectively, such that first and second chains of magnets 302, 402 are of opposite polarity.

Figure 9:
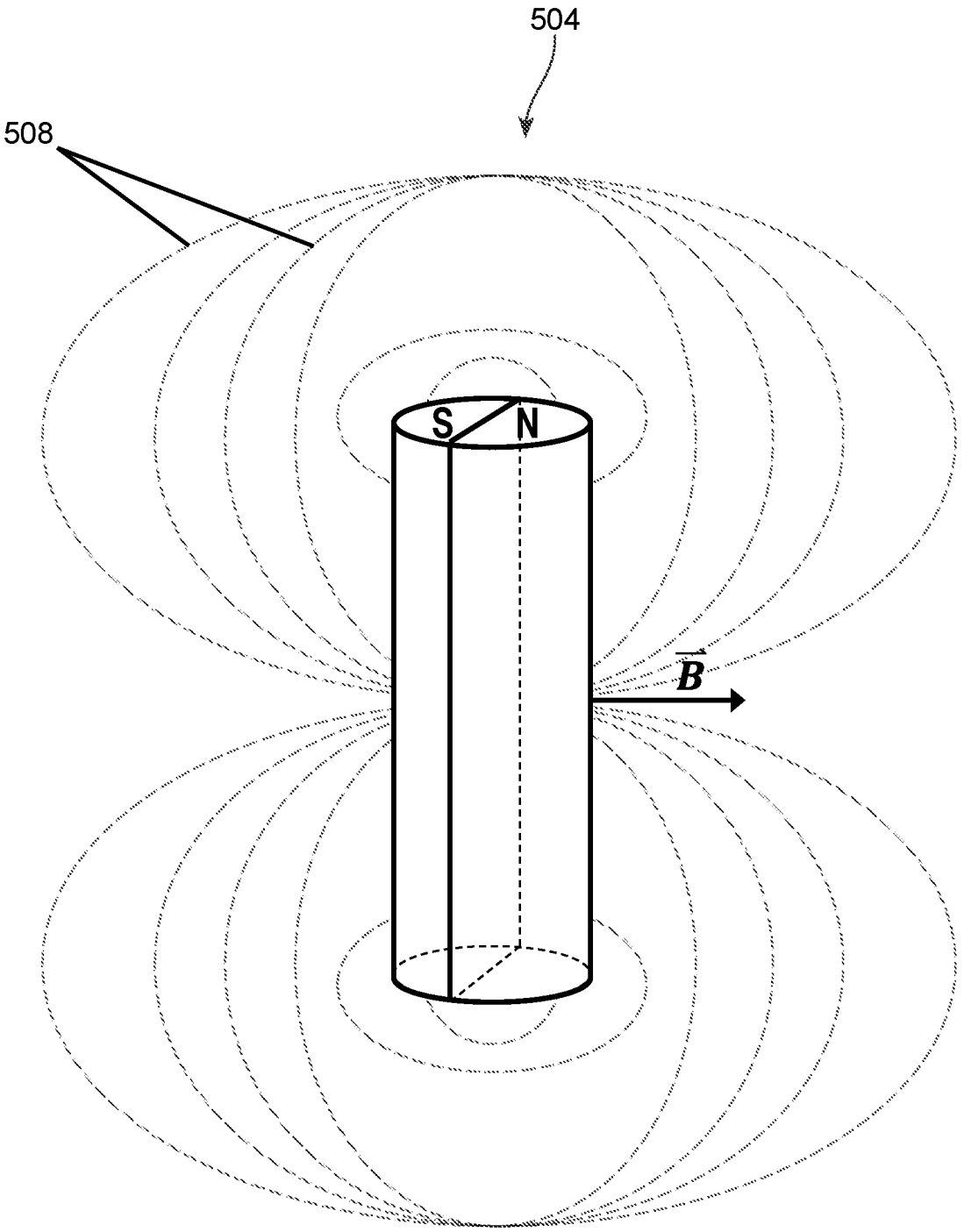
FIG. 9 illustrates a diametrically magnetized magnet, according to an embodiment.
Figure 10:
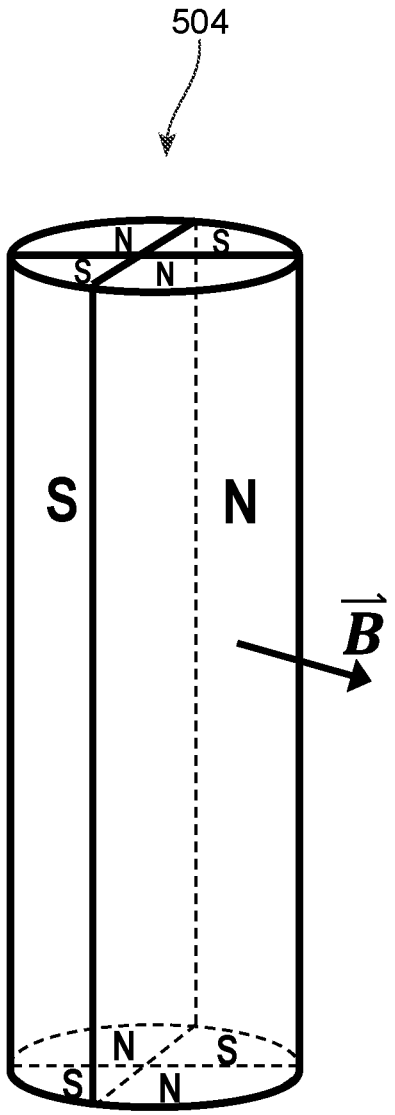
FIG. 10 illustrates a diametrically magnetized magnet, according to an embodiment.

FIGS. 9-10 illustrate diametrically magnetized magnet 504, according to embodiments. Diametrically magnetized magnet 504, unlike an axially magnetized magnet, is magnetized along its diameter. In some embodiments, first and second longitudinal elongated metallic elements 300, 400 can be first and second chains of magnets 302, 402 which can be diametrically magnetized magnets 504. Thus, when first and second chains of magnets 302, 402 are diametrically opposed 500, as shown in FIG. 6C, for example, the magnetic ($\vec{B}$) force is stronger diametrically (e.g., $\underline{B}$ direction) than axially (e.g., first and second longitudinal axes 312, 412). Further, the magnetic ($\vec{B}$) force is enhanced and increases as each pair of diametrically opposed 500 magnets of first and second chains of magnets 302, 402 align along first and second longitudinal axes 312, 412, respectively. As shown in FIG. 9, in some embodiments, diametrically magnetized magnet 504 can include first semicylinder (i.e., N) and second semicylinder (i.e., S) of opposite polarity. Diametrically magnetized magnet 504 produces magnetic field lines 508 and a magnetic ($\vec{B}$) force along the diameter away from first semicylinder (i.e., N). In some embodiments, diametrically magnetized magnet 504 includes a plurality of first (i.e., N) and second (i.e., S) cylindrical sections of opposite polarity. For example, as shown in FIG. 10, diametrically magnetized magnet 504 can include first quarter cylinders (i.e., N) and second quarter cylinders (i.e., S) of opposite polarity in an alternating arrangement.

Figure 11:
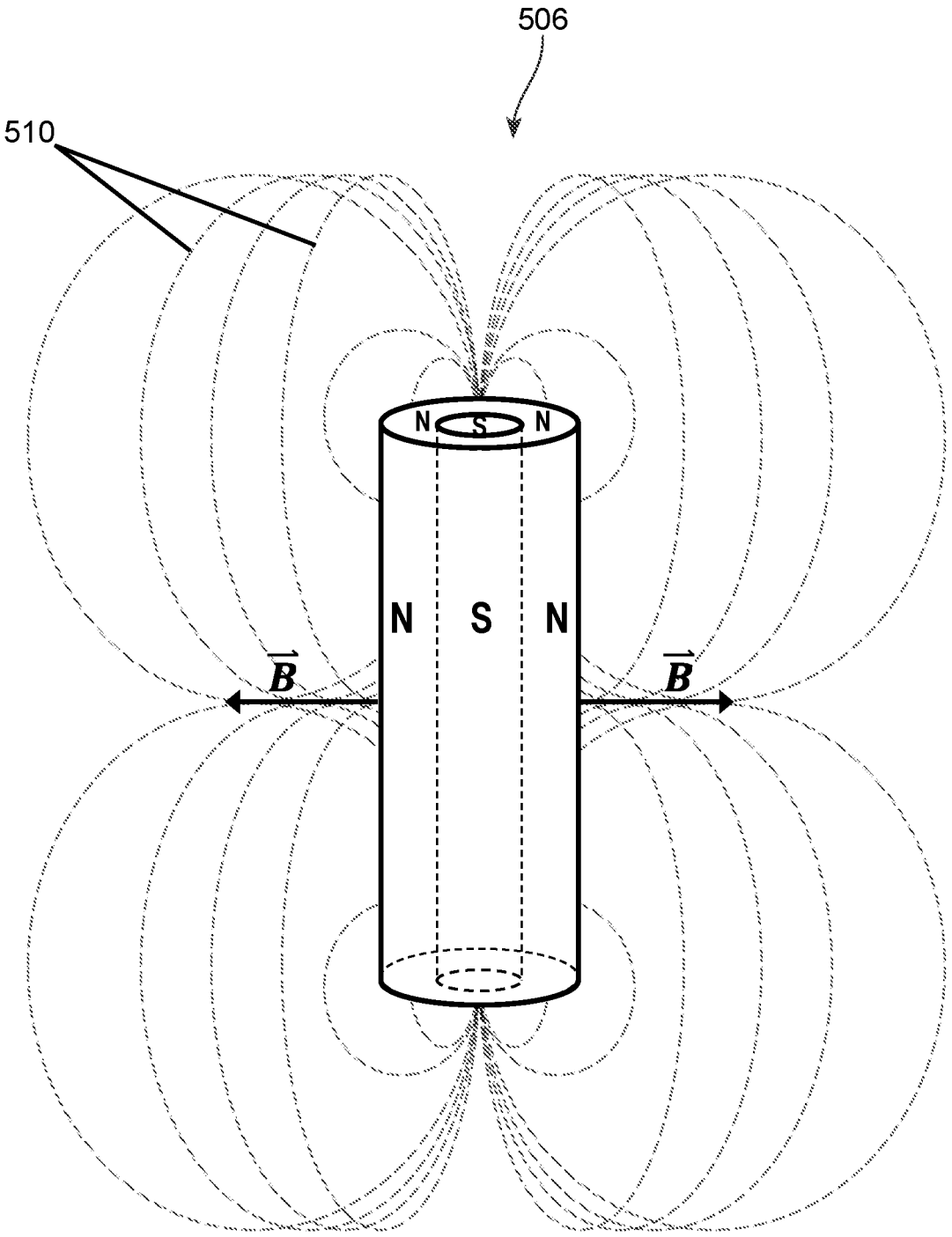
FIG. 11 illustrates a radially magnetized magnet, according to an embodiment.

FIG. 11 illustrates radially magnetized magnet 506, according to an embodiment. Radially magnetized magnet 506, similar to diametrically magnetized magnet 504, is magnetized along its radius. In some embodiments, first and second longitudinal elongated metallic elements 300, 400 can be first and second chains of magnets 302, 402 which can be radially magnetized magnets 506. Thus, when first and second chains of magnets 302, 402 are diametrically opposed 500, as shown in FIG. 6C, for example, the magnetic ($\vec{B}$) force is stronger radially (e.g., $\vec{B}$ direction) than axially (e.g., first and second longitudinal axes 312, 412). Further, the magnetic ($\vec{B}$) force is enhanced and increases as each pair of diametrically opposed 500 magnets of first and second chains of magnets 302, 402 align along first and second longitudinal axes 312, 412, respectively. As shown in FIG. 11, in some embodiments, radially magnetized magnet 506 can include outer cylindrical shell (i.e., N) and inner cylinder (i.e., S) of opposite polarity. Radially magnetized magnet 506 produces magnetic field lines 510 and a magnetic ($\vec{B}$) force along the radius away from outer cylindrical shell (i.e., N). In some embodiments, radially magnetized magnet 506 can include outer cylindrical shell (i.e., S) and inner cylinder (i.e., N) of opposite polarity.

It is to be appreciated that the Detailed Description section, and not the Brief Summary and Abstract sections, is intended to be used to interpret the claims. The Summary and Abstract sections may set forth one or more but not all exemplary embodiments of the automatic hydration tube return system and apparatus, and thus, are not intended to limit the present embodiments and the appended claims.

The present disclosure has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the disclosure that others can, by applying knowledge within the skill of the art, readily modify and/or adapt for various applications such specific embodiments, without undue experimentation, without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present disclosure should not be limited by any of the above-described exemplary embodiments, but should be defined only in accordance with the following claims and their equivalents.

What is claimed is:

1. A hydration pack, comprising:

a main body defining a storage compartment;

a strap coupled to the main body;

a bladder disposed in the storage compartment of the main body and configured to retain liquid;

a hydration tube comprising a proximal end coupled to the bladder and a distal end;

a first chain of magnets disposed on the strap; and a second chain of magnets disposed along a length of the hydration tube, wherein the first and second chains of magnets are configured to connect by magnetic forces and disconnect by a force exceeding the magnetic force of the first and second chains of magnets.

2. The hydration pack of claim 1, wherein:

the first chain of magnets is disposed end-to-end, and the second chain of magnets is disposed end-to-end.

3. The hydration pack of claim 1, wherein:

the first chain of magnets is disposed within a first sleeve coupled to the strap, and the second chain of magnets is disposed within a second sleeve coupled to the hydration tube.

4. The hydration pack of claim 3, wherein the second sleeve is coupled to a third sleeve disposed about the hydration tube, wherein the third sleeve is configured to slide along a length of the hydration tube.

5. The hydration pack of claim 1, wherein the first and second chains of magnets are flexible.

6. The hydration pack of claim 1, wherein the first and second chains of magnets each contain 3 to 9 magnets.

7. The hydration pack of claim 1, wherein the first and second chains of magnets are diametrically opposed.

8. The hydration pack of claim 1, further comprising a valve disposed at the distal end of the hydration tube, wherein the bladder comprises a fill port for transferring liquid to the bladder and a discharge port for transferring liquid from the bladder, wherein the discharge port is connected to the proximal end of the hydration tube.

9. The hydration pack of claim 1, wherein the first and second chains of magnets are each diametrically magnetized magnets arranged such that they are diametrically opposed with opposite polarity.

10. The hydration pack of claim 1, wherein the first and second chains of magnets are each radially magnetized magnets arranged such that they are radially opposed with opposite polarity.

11. The hydration pack of claim 1, wherein the first and second chains of magnets are each arranged such that they are opposed with opposite polarity.

12. The hydration pack of claim 1, wherein the first and second chains of magnets are each bendable magnets arranged such that they are opposed with opposite polarity.

13. A hydration system for providing liquid to a user on demand, comprising:

a pack comprising a main body having a front side facing towards and adjacent to a user when the pack is carried, a back side facing away from the user when the pack is carried, and a strap coupled to the main body;

a bladder disposed in the main body of the pack configured to retain liquid, the bladder comprising a fill port for transferring liquid to the bladder and a discharge port for transferring liquid from the bladder;

a hydration tube extending from the bladder through an opening in the main body, wherein the hydration tube is configured to transfer liquid from a proximal end connected to the discharge port to a distal end;

a valve disposed at the distal end of the hydration tube including an outlet configured to discharge liquid into the user's mouth;

a first plurality of magnets coupled to the strap; and a second plurality of magnets coupled to the hydration tube, wherein the first and second pluralities of magnets are configured to connect by gravitational and magnetic forces when the hydration tube is released from the user's mouth and disconnect when the user exerts a force exceeding the magnetic force of the first and second pluralities of magnets, and wherein upon release of the valve from the user's mouth the second plurality of magnets sequentially connects by magnetic force to the first plurality of magnets.

14. The hydration system of claim 13, wherein the first and second pluralities of magnets are diametrically magnetized.

15. The hydration system of claim 13, further comprising an adjustable sleeve disposed about the hydration tube, wherein the second plurality of magnets is coupled to the sleeve and the magnets of the second plurality of magnets are disposed end-to-end.

16. A hydration pack, comprising:

a main body defining a storage compartment;

a strap coupled to the main body;

a bladder disposed in the storage compartment of the main body and configured to retain liquid;

a hydration tube comprising a proximal end coupled to the bladder and a distal end;

a valve disposed at the distal end of the hydration tube;

a first plurality of magnets disposed along a length of the strap; and a second plurality of magnets disposed along a length of the hydration tube between the bladder and the valve, wherein the first and second pluralities of magnets are configured to connect by magnetic forces and disconnect by a force exceeding the magnetic force of the first and second pluralities of magnets.

17. The hydration pack of claim 16, wherein:

the first plurality of magnets is disposed within a first sleeve coupled to the strap, and the second plurality of magnets is disposed within a second sleeve coupled to the hydration tube.

18. The hydration pack of claim 16, wherein the main body is configured to be disposed against a user's back and the strap is configured to be disposed on a front side of the user.

19. The hydration pack of claim 16, wherein the first plurality of magnets is disposed end-to-end in a lengthwise direction of the strap and the second plurality of magnets is disposed end-to-end in a lengthwise direction of the hydration tube.

20. The hydration pack of claim 16, further comprising a second strap coupled to the main body.

* * * * *